US010180065B1

(12) United States Patent
Sollami

(10) Patent No.: US 10,180,065 B1
(45) Date of Patent: Jan. 15, 2019

(54) MATERIAL REMOVING TOOL FOR ROAD MILLING MINING AND TRENCHING OPERATIONS

(71) Applicant: Phillip Sollami, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 62 days.

(21) Appl. No.: 15/261,277

(22) Filed: Sep. 9, 2016

Related U.S. Application Data

(60) Provisional application No. 62/237,070, filed on Oct. 5, 2015.

(51) Int. Cl.
*E21C 35/183* (2006.01)
*E21C 35/19* (2006.01)
*E21C 35/18* (2006.01)

(52) U.S. Cl.
CPC ..... *E21C 35/19* (2013.01); *E21C 35/183* (2013.01); *E21C 2035/1803* (2013.01); *E21C 2035/1806* (2013.01); *E21C 2035/1809* (2013.01); *E21C 2035/1813* (2013.01); *E21C 2035/1816* (2013.01)

(58) Field of Classification Search
CPC ..... E21C 2035/1803; E21C 2035/1806; E21C 2035/1813; E21C 35/183; E21C 35/18; E21C 2035/1809; E21C 2035/1816
See application file for complete search history.

(56) References Cited

U.S. PATENT DOCUMENTS

| | | | | |
|---|---|---|---|---|
| 3,397,012 | A | 8/1968 | Krekeler | |
| 3,519,309 | A | 7/1970 | Engle | |
| 3,865,437 | A | 2/1975 | Crosby | |
| 4,084,856 | A | 4/1978 | Emmerich | |
| 4,247,150 | A | 1/1981 | Wrulich et al. | |
| 4,277,106 | A * | 7/1981 | Sahley | E02F 9/285 125/43 |
| 4,310,939 | A | 1/1982 | Iijima | |
| 4,453,775 | A | 6/1984 | Clemmow | |
| 4,478,298 | A | 10/1984 | Hake | |
| 4,489,986 | A | 12/1984 | Dziak | |
| 4,525,178 | A | 6/1985 | Hall | |
| 4,561,698 | A | 12/1985 | Beebe | |
| 4,570,726 | A | 2/1986 | Hall | |
| 4,604,106 | A | 8/1986 | Hall | |

(Continued)

FOREIGN PATENT DOCUMENTS

| | | |
|---|---|---|
| DE | 102004049710 | 4/2006 |
| DE | 102011079115 | 1/2013 |

(Continued)

*Primary Examiner* — John J Kreck
*Assistant Examiner* — Michael A Goodwin
(74) *Attorney, Agent, or Firm* — Mercedes V. O'Connor; James N. Videbeck; Rockman Videbeck & O'Connor

(57) ABSTRACT

An improved tool is described that has a generally cylindrical slotted shank with a radially bulbous or extending portion adjacent a distal end of the shank, sized to interfere with a bore in which the shank is to be inserted. The dimension of the extending portion can be sized to change the retention force between the shank and the bore as desired. A top of the tool includes a metal carbide-metal disk-metal carbide diamond coated tip sandwich that is bonded inside a bore in the top of the tool.

19 Claims, 3 Drawing Sheets

(56) References Cited

U.S. PATENT DOCUMENTS 4,694,918 A 9/1987 Hall
4,763,956 A 8/1988 Emmerich
4,811,801 A 3/1989 Salesky
4,818,027 A 4/1989 Simon
4,844,550 A 7/1989 Beebe
4,915,455 A 4/1990 O'Niell
4,944,559 A 7/1990 Sionett
5,067,775 A 11/1991 D'Angelo
5,088,797 A 2/1992 O'Neill
5,098,167 A 3/1992 Latham
5,159,233 A 10/1992 Sponseller
5,161,627 A 11/1992 Burkett
5,273,343 A 12/1993 Ojanen
5,287,937 A 2/1994 Sollami
5,302,005 A 4/1994 O'Neill
5,303,984 A 4/1994 Ojanen
5,352,079 A 10/1994 Croskey
5,370,448 A 12/1994 Sterwerf, Jr.
5,374,111 A 12/1994 Den Besten
5,415,462 A 5/1995 Massa
5,417,475 A 5/1995 Graham et al.
5,458,210 A 10/1995 Sollami
5,492,188 A 2/1996 Smith et al.
5,607,206 A 3/1997 Siddle
5,628,549 A 5/1997 Ritchey
5,645,323 A * 7/1997 Beach ..... E21B 10/12 299/111
5,725,283 A 3/1998 O'Neill
5,837,071 A * 11/1998 Andersson ..... E21C 35/183 148/528
5,931,542 A 8/1999 Britzke
5,992,405 A 11/1999 Sollami
D420,013 S 2/2000 Warren
6,102,486 A 8/2000 Briese
6,176,552 B1 1/2001 Topka, Jr.
6,250,535 B1 6/2001 Sollami
6,331,035 B1 12/2001 Montgomery, Jr.
6,357,832 B1 3/2002 Sollami
6,371,567 B1 4/2002 Sollami
6,508,516 B1 1/2003 Kammerer
6,517,902 B2 * 2/2003 Drake ..... C22C 1/1094 427/249.13
D471,211 S 3/2003 Sollami
6,585,326 B2 7/2003 Sollami
6,685,273 B1 2/2004 Sollami
6,692,083 B2 2/2004 Latham
D488,170 S 4/2004 Sollami
6,733,087 B2 5/2004 Hall
6,739,327 B2 5/2004 Sollami
6,786,557 B2 9/2004 Montgomery
6,824,225 B2 11/2004 Stiffler
6,846,045 B2 1/2005 Sollami
6,854,810 B2 2/2005 Montgomery
6,866,343 B2 3/2005 Holl et al.
6,968,912 B2 11/2005 Sollami
6,994,404 B1 2/2006 Sollami
7,097,258 B2 8/2006 Sollami
7,118,181 B2 10/2006 Frear
7,150,505 B2 12/2006 Sollami
7,195,321 B1 3/2007 Sollami
7,210,744 B2 5/2007 Montgomery
7,229,136 B2 6/2007 Sollami
7,234,782 B2 6/2007 Stehney
D554,162 S 10/2007 Hall
7,320,505 B1 1/2008 Hall
7,338,135 B1 3/2008 Hall
7,347,292 B1 3/2008 Hall
D566,137 S 4/2008 Hall
7,353,893 B1 4/2008 Hall
7,384,105 B2 6/2008 Hall
7,396,086 B1 6/2008 Hall
7,401,862 B2 7/2008 Holl et al.
7,401,863 B1 7/2008 Hall
7,410,221 B2 8/2008 Hall
7,413,256 B2 8/2008 Hall
7,413,258 B2 8/2008 Hall
7,419,224 B2 9/2008 Hall
7,445,294 B2 11/2008 Hall
D581,952 S 12/2008 Hall
7,464,993 B2 12/2008 Hall
7,469,756 B2 12/2008 Hall
7,469,971 B2 12/2008 Hall
7,469,972 B2 12/2008 Hall
7,475,948 B2 1/2009 Hall
7,523,794 B2 4/2009 Hall
7,568,770 B2 8/2009 Hall
7,569,249 B2 8/2009 Hall
7,571,782 B2 8/2009 Hall
7,575,425 B2 8/2009 Hall
7,588,102 B2 9/2009 Hall
7,594,703 B2 9/2009 Hall
7,600,544 B1 10/2009 Sollami
7,600,823 B2 10/2009 Hall
7,628,233 B1 12/2009 Hall
7,635,168 B2 12/2009 Hall
7,637,574 B2 12/2009 Hall
7,648,210 B2 1/2010 Hall
7,665,552 B2 2/2010 Hall
7,669,938 B2 3/2010 Hall
7,681,338 B2 3/2010 Hall
7,712,693 B2 5/2010 Hall
7,717,365 B2 5/2010 Hall
7,722,127 B2 5/2010 Hall
7,789,468 B2 9/2010 Sollami
7,832,808 B2 11/2010 Hall
7,883,155 B2 2/2011 Sollami
7,950,745 B2 5/2011 Sollami
7,963,617 B2 6/2011 Hall
7,992,944 B2 8/2011 Hall
7,992,945 B2 8/2011 Hall
7,997,661 B2 8/2011 Hall
8,007,049 B2 8/2011 Fader
8,007,051 B2 8/2011 Hall
8,029,068 B2 10/2011 Hall
8,033,615 B2 10/2011 Hall
8,033,616 B2 10/2011 Hall
8,038,223 B2 10/2011 Hall
8,061,784 B2 11/2011 Hall
8,109,349 B2 2/2012 Hall
8,118,371 B2 2/2012 Hall
8,136,887 B2 3/2012 Hall
8,201,892 B2 6/2012 Hall
8,215,420 B2 7/2012 Hall
8,292,372 B2 10/2012 Hall
8,414,085 B2 4/2013 Hall
8,449,039 B2 5/2013 Hall
8,485,609 B2 7/2013 Hall
8,500,209 B2 8/2013 Hall
8,540,320 B2 9/2013 Sollami
RE44,690 E 1/2014 Sollami
8,622,482 B2 1/2014 Sollami
8,622,483 B2 1/2014 Sollami
8,646,848 B2 2/2014 Hall
8,728,382 B2 5/2014 Hall
9,004,610 B2 4/2015 Erdmann et al.
9,028,008 B1 5/2015 Bookhamer
9,039,099 B2 5/2015 Sollami
9,316,061 B2 4/2016 Hall
2002/0167216 A1 11/2002 Sollami
2003/0015907 A1 1/2003 Sollami
2003/0047985 A1 3/2003 Shifter
2004/0004389 A1 1/2004 Latham
2004/0174065 A1 9/2004 Sollami
2006/0071538 A1 4/2006 Sollami
2006/0186724 A1 8/2006 Stehney
2008/0035386 A1 2/2008 Hall et al.
2009/0261646 A1 10/2009 Ritchie et al.
2010/0244545 A1 9/2010 Hall
2010/0253130 A1 10/2010 Sollami
2011/0006588 A1 1/2011 Monyak et al.
2011/0089747 A1 4/2011 Helsel
2011/0204703 A1 8/2011 Sollami
2011/0254350 A1 10/2011 Hall
2012/0027514 A1 2/2012 Hall

(56) References Cited

U.S. PATENT DOCUMENTS

2012/0068527 A1 3/2012 Erdmann
2012/0181845 A1 7/2012 Sollami
2012/0248663 A1 10/2012 Hall
2012/0261977 A1 10/2012 Hall
2012/0280559 A1 11/2012 Watson
2012/0286559 A1 11/2012 Sollami
2012/0319454 A1 12/2012 Swope
2013/0169023 A1 7/2013 Monyak
2013/0187438 A1* 7/2013 Hall ..... E21C 35/183 299/113
2014/0262541 A1* 9/2014 Parsana ..... E21B 10/567 175/428
2014/0265530 A1* 9/2014 Fries ..... C22C 1/00 299/106
2014/0326516 A1 11/2014 Haugvaldstad
2014/0354033 A1* 12/2014 Easley ..... E21C 35/18 299/113
2015/0028656 A1 1/2015 Sollami
2015/0211365 A1* 7/2015 Hall ..... E21C 35/183 299/105
2015/0240634 A1 8/2015 Sollami
2015/0285074 A1 10/2015 Sollami
2015/0292325 A1 10/2015 Sollami
2015/0300166 A1 10/2015 Ries et al.
2015/0308488 A1 10/2015 Kahl
2015/0315910 A1 11/2015 Sollami
2015/0354285 A1 12/2015 Hall
2016/0194956 A1 7/2016 Sollami
2017/0089198 A1 3/2017 Sollami

FOREIGN PATENT DOCUMENTS

DE 202012100353 6/2013
DE 102015121953 7/2016
DE 102016118658 3/2017
GB 2483157 2/2012
WO 2008105915 A2 9/2008
WO 2008105915 A3 9/2008
WO 2009006612 1/2009

* cited by examiner

ASSEMBLY OF COMPONENTS

STEP 1

STEP 2

FINAL PRODUCT

MATERIAL REMOVING TOOL FOR ROAD MILLING MINING AND TRENCHING OPERATIONS

CROSS-REFERENCE TO RELATED APPLICATION(S)

This application claims priority to U.S. Provisional Application No. 62/237,070, filed Oct. 5, 2015, to the extent allowed by law and the contents of which are incorporated herein by reference in its entirety.

TECHNICAL FIELD

This disclosure relates generally to road milling, mining and trenching equipment and, more particularly, to replaceable hardened tip tools or bits that are utilized at the leading edge of such equipment where material removal initially takes place.

BACKGROUND

Tools or bits have historically been selectably removably retained in tool holders, base blocks, and the like. When they are worn out, they may be driven from their mountings and replaced by new or reconditioned such tools. Such a tool with a hardened tip can be found in applicant's prior U.S. Pat. No. 6,739,327. For some time, such cutting tools have had hardened tips, preferably made of tungsten carbide.

More recently, the use of diamond material, either industrial or manmade, as coatings or layers on the tips of the inserts, preferably still made of tungsten carbide, have found their way into material removing equipment. Tungsten carbide tipped tools have generally been rotatable in their bit holders or base blocks. The use of longer lasting diamond tipped inserts has for some operations given way to a one piece tool-bit holder combination, sometimes called a pick. With such a pick, the diamond tipped insert is integrally formed at the top of the bit holder which, in turn, is selectably removeably mounted in a base block.

The additional working life of the diamond tipped inserts has meant that generally longer use life could be had without needing rotatability of the tools. However, at present, the layering or coating of such diamond material on insert bases has proven not to be usable in all such material removing instances. While such diamond tipped tools may be usable to remove the top of long stretches of straight highway materials, such diamond tipped tools have not been so successful in removing material from concrete surfaces. This has necessitated changing the entire set of picks (or bit/holder combinations) from a drum when removing portions of certain stretches of highway segments. Aside from changing out the picks on an entire drum, which include potentially hundreds of picks, there also exists the potential of maintaining multiple drums, some having diamond tipped inserts mounted on the drums and others having tungsten carbide tipped inserts mounted on the drums. The added costs in downtime, changing picks, and/or in capital in maintaining multiple drums is substantial.

A need has developed for improved cutting tools or bits, especially diamond tipped cutting tools, that may be more easily and quickly removed and changed out of drums or endless chains utilized for mounting such tools thereon.

SUMMARY

This disclosure relates generally to bit assemblies for road milling, mining, and trenching equipment. One implementation of the teachings herein is a tool that includes a metal body and a generally cylindrical shank depending therefrom, the shank including a bulbous portion adjacent a distal end thereof, a slot in the shank extending axially upwardly from the distal end substantially through the bulbous portion thereof and inwardly from a side wall thereof toward a maximum diametrical dimension of an inner bore in the shank.

These and other aspects of the present disclosure are disclosed in the following detailed description of the embodiments, the appended claims and the accompanying figures.

BRIEF DESCRIPTION OF THE DRAWINGS

The various features, advantages, and other uses of the apparatus will become more apparent by referring to the following detailed description and drawings, wherein like reference numerals refer to like parts throughout the several views. It is emphasized that, according to common practice, the various features of the drawings are not to-scale. On the contrary, the dimensions of the various features are arbitrarily expanded or reduced for clarity.

DETAILED DESCRIPTION

Figure 1:
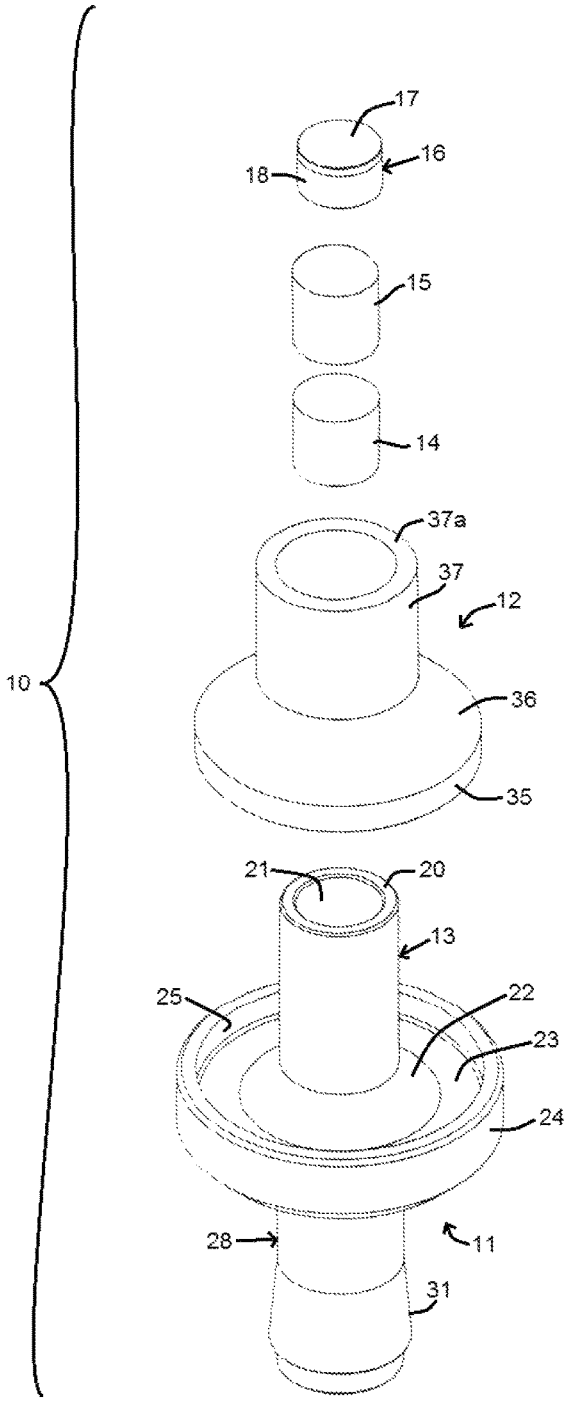
FIG. 1 is an exploded perspective view of a first embodiment of the bit having a reverse taper shank constructed in accordance with the present disclosure.
Figure 2:
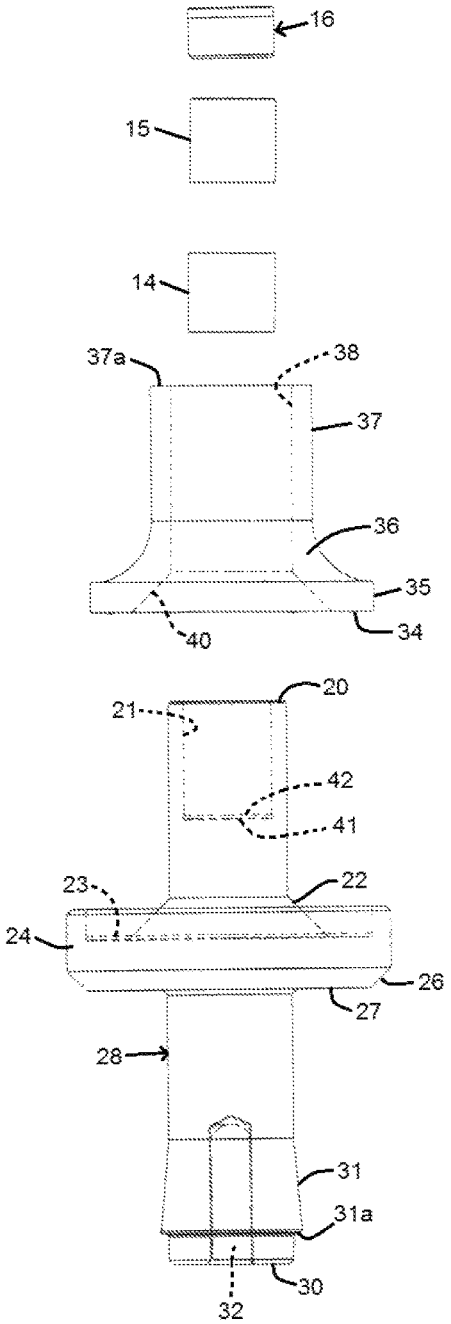
FIG. 2 is an exploded side elevational view of the bit as shown in FIG. 1.

Referring to FIGS. 1 and 2, a first embodiment of a tool or bit 10, constructed in accordance with the present disclosure, suitable for use in road milling, mining and trenching operations, includes a steel body 11, an annular tungsten carbide shield 12 mounted on a generally cylindrical upper or top portion 13 of the body, a tungsten carbide plug 14, a steel plug 15 (to be modified as disclosed hereafter), and a hardened tip 16. In this first embodiment, the hardened tip 16 has a diamond material layer or coating 17 and a tungsten carbide substrate or base 18. The diamond material may be polycrystalline diamond (PCD), industrial diamond, or a solid or layered thermally stable polycrystalline diamond (TSP).

The main body 11 of the tool 10, that in this first embodiment is preferably made of steel, includes the generally cylindrical top portion 13 that has an annular uppermost surface 20 with a central bore 21 extending therein part way along the length of the top of the generally cylindrical top portion 13. A frustoconical base 22 of the top portion 13 extends downwardly and outwardly forming the inside of an annular trough 23 in what would be termed a tire portion 24, or washer portion, i.e., the largest outer diameter portion of the tool or bit 10. The annular trough 23 has a substantially flat annular bottom in this first embodiment. The tire portion 24 also includes a vertical annular wall 25. The tire portion 24 or base is generally solid and extends downwardly to a chamfer 26 (FIG. 2) defining the outside of a rear annular flange 27.

Descending from the rear annular flange 27 is a generally cylindrical shank 28, about 25/32 inch in diameter, although variations in shank diameters are found, 1½ inch on the low end, and larger on mining and trenching equipment. The shank 28 is solid along an upper portion of same and has, adjacent a distal end 30 of the shank 28, generally a bulbous portion. In this first embodiment, the shank 28 includes a reverse taper or expanding skirt portion 31 adjacent the distal end 30, with the generally annular distal end 30 of the shank 28 being slightly smaller than the widest bottom portion 31*a* of the skirt portion 31. The shank 28 further includes a bore 32 extending generally inwardly of the distal end 30 thereof, up through the reverse taper or skirt portion 31 of the tool 10. The bore 32 is contiguous with a slot 33 (FIGS. 3-5) extending to the outer surface of the reverse taper or skirt portion 31 of the shank 28.

The interference fit provides a shank to bore connection that prevents bit rotation during use, but still allows for a manual rotation by gripping the outer diameter of the tire portion 24 with a pipe wrench type of tool (not shown) to cover an index of the bit. An index of 180 degrees of the PCD bit tip 16 will present an unused diamond tip surface portion to contact the material to be removed.

In this first embodiment of the tool or bit 10, the outer diameter of the washer or tire portion 24 is about 2 inches and is larger than the diameter of the nose of a bit holder (not shown) into which the tool or bit 10 is inserted. The shank 28 has an overall length approximating 1⅝ inches and the reverse taper portion 31 is about ¾ inch in vertical length or height.

The protective member, shield or shroud 12 positioned or mounted adjacent the top of the bit or tool upper portion 13, is an annular tungsten carbide shroud. In this first embodiment, the annular tungsten carbide shroud 13 includes an annular bottom flange 34 having a vertical side surface 35, a curved inwardly extending side wall 36 upwardly thereadjacent, and a hollow cylindrical upper portion 37. The hollow upper portion 37 is defined by a bore 38 centrally therethrough and adjacent the bottom of the bore 38 is a hollow frustoconical portion 40. This hollow portion, the bore 38 and the hollow frustoconical portion 40, is matingly complementary to the upper portion 13 of the tool body 11 above the washer or tire portion 24. The bottom flange 34 of the protective member 12 fits in the annular trough 23 of the washer or tire portion 24 of the tool 10.

As shown in FIGS. 1 and 2, the tungsten carbide shield or shroud 12 is sized to be fitted on and brazed to the upper portion 13 of the tool body 11. The generally cylindrical tungsten carbide plug 14, positioned above the annular tungsten carbide shroud 12 as shown, is sized to be complementarily fitted (brazed) into the bore 21 extending axially inwardly from the top 20 of the generally cylindrical upper portion 13 of the tool body 11, to be discussed in more detail below. This tungsten carbide plug 14 provides added stiffness to the upper portion 13 of the bit or tool body 11 while also adding strength and toughness to the central part of the upper portion 13 of the tool body 11.

Additionally, this generally cylindrical tungsten carbide plug 14 is less expensive to make than would be a bit tip or insert with a hardened coating or layer positioned on top thereof that had a cylindrical body of the length of the combined bit tip with the tungsten carbide plug. Therefore, the hardened insert or tip 16 utilized can be a commercially available product.

The generally cylindrical steel plug 15 is positioned between the insert or bit tip 16, with the hardened layer or coating 17 on top of the tungsten carbide generally cylindrical base 18 and the tungsten carbide plug 14, as shown in FIG. 1. This generally cylindrical steel plug 15 will be utilized during the assembly of the components of the tool 10 and will be modified as to be discussed in more detail below.

Figure 3:
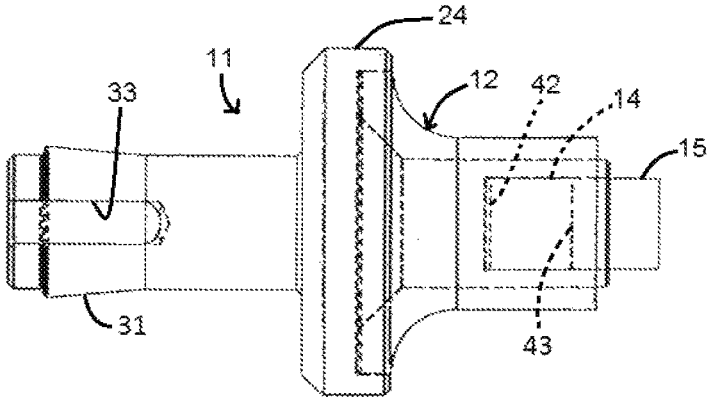
FIG. 3 is a front elevational view of the bit shown in FIG. 1 assembled with its steel plug intact.
Figure 4:
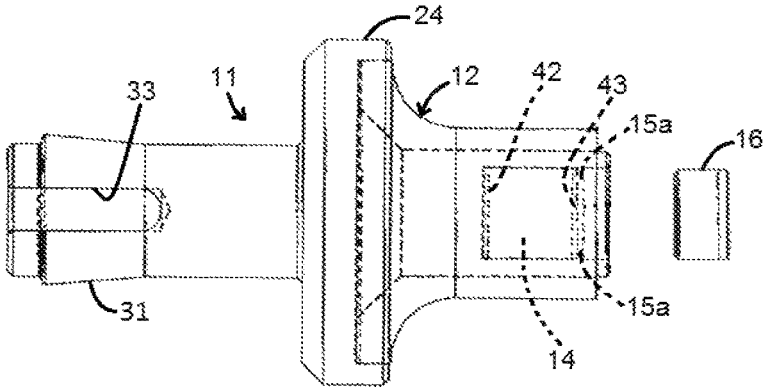
FIG. 4 is a front elevational view of the bit showing its steel plug reduced to a thin disc.
Figure 5:
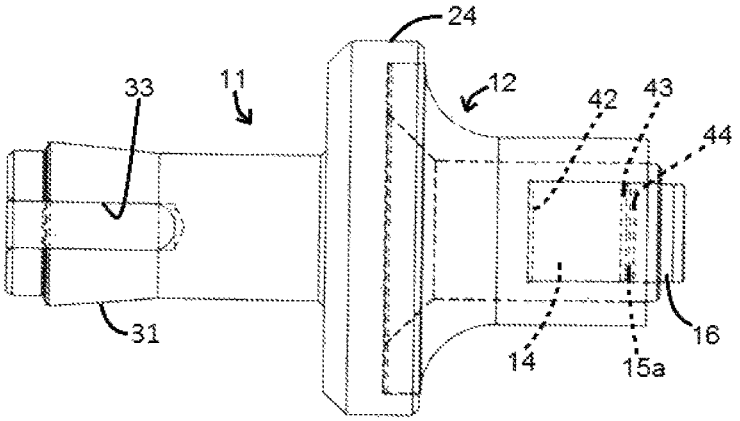
FIG. 5 is a front elevational view of a completely assembled bit.

Referring to FIGS. 3-5, the assembly of the components shown in FIGS. 1 and 2 is shown in greater detail. In step 1, shown in FIG. 3, the body 11 of the bit or tool 10 has the generally annular tungsten carbide shroud 12 fitted over the generally cylindrical upper portion 13 of the body 11 and has a brazing ring (not shown) positioned in the trough 23 of the washer or tire portion 24 of the tool 10. The tungsten carbide plug 14 is positioned in the bore 21 through the top 20 of the upper portion 13 of the body 11 of the tool 10 and has a first brazing disk 42 positioned on a bottom 41 of the bore 21. The steel plug 15 is positioned in the top of the bore 21 and further includes a second brazing disk 43 positioned between the bottom of the steel plug 15 and the top of the tungsten carbide plug 14. In FIG. 3, the steel plug 15 extends outwardly of the bore 21 of the upper portion 13 of the bit or tool body 11 when initially inserted therein.

The entire assembly, as shown in FIG. 3, minus the bit tip or insert 16, is heated to a temperature of about 1,800 degrees Fahrenheit ("F"), wherein the brazing material melts or becomes a liquid and adheres the separate components together in a unitary structure.

It should be noted that the use of the steel plug 15, being brazed to the top of the tungsten carbide plug 14, provides a greater adherence thereto than if the tungsten carbide plug 14 would be brazed to the bottom of the tungsten carbide base 18 of the bit tip or insert 16. After the assembly of the parts in step 1 is completed, the entire tool is heat treated to a hardness of RC 40-50.

Referring to step 2 in FIGS. 4 and 5, the steel plug 15 at the top of the tool or bit 10 upper portion 13 is thereafter largely removed from the tool 10, by cutting, boring or otherwise removing most of the steel plug 15 until only approximately a 0.030 inch thick disk 15*a* (FIG. 5) remains brazed to the top of the tungsten carbide plug 14. Thereafter, the commercially obtainable insert or tip 16 which, in this embodiment includes the generally cylindrical tungsten carbide substrate 18 with the PCD or diamond coating or layer 17 positioned on the top thereof with a flat, rounded or cone shaped leading surface, is combined with a third brazing disk 44 to braze same on top of the now 0.030 inch thick steel disk 15*a*. This provides a tungsten carbide-steel-tungsten carbide sandwich which, when brazed together, is stronger than would be the combination of brazing the tungsten carbide plug 14 to the tungsten carbide base 18 of the hardened tip 16.

Also, in order to maintain the integrity of the coating or layer 17 on the top of the tip or insert 16, this additional brazing operation is carried out at a lower temperature than the initial brazing operation by cooling the tool body to a temperature below that which would cause harm to the diamond impregnated material on the impact tip. This additional brazing operation of the hardened tip 16 is carried out at approximately 1,300 degrees F. or less.

FIG. 5 discloses the final product of the tool body with the annular shroud 12 brazed to the top of the outside of the upper portion 13 thereof and the tungsten carbide plug 14 brazed to the inside of the bore 21 of the upper portion 13, with about a 0.030 inch thick steel disk 15*a* brazed on the top of the tungsten carbide plug 14 and, in turn, brazed to the base 18 of the coated tip or insert 16.

The combination sandwich of the tungsten carbide plug 14, the steel disk 15*a* and the tungsten carbide substrate 18 with the preferably diamond material coated tip 17 of the tip or insert 16, provides not only a stronger central portion of the upper portion 13 of the tool 10, but also provides a structure which is substantially less expensive by utilizing a commercially obtainable insert 16 with the tungsten carbide plug 14. If an tip or insert were to be formed having the total height of the sandwich shown in FIG. 5, it would be substantially more expensive than the present structure.

An additional benefit is obtained utilizing the steel disk 15*a* in the tungsten carbide-steel-tungsten carbide sandwich in that the steel disk 15*a* has an expansion ratio (i.e., coefficient of expansion) that is higher than tungsten carbide so when the bit or tool 10 is utilized in service, the operating temperature of the tool 10 will rise when frictionally removing material to about 700-800 degrees F. With this increase in temperature, the steel disk 15*a* expands radially outwardly at about 150 percent of the rate of the tungsten carbide plug 14 and tungsten carbide substrate 18, thus providing not only greater brazing adherence in the sandwich, but also a tighter axial stiffness between the carbide plug 14, the steel disk 15*a* and the PCD insert 16 at the upper portion 13 of the tool body 10.

Figure 6:
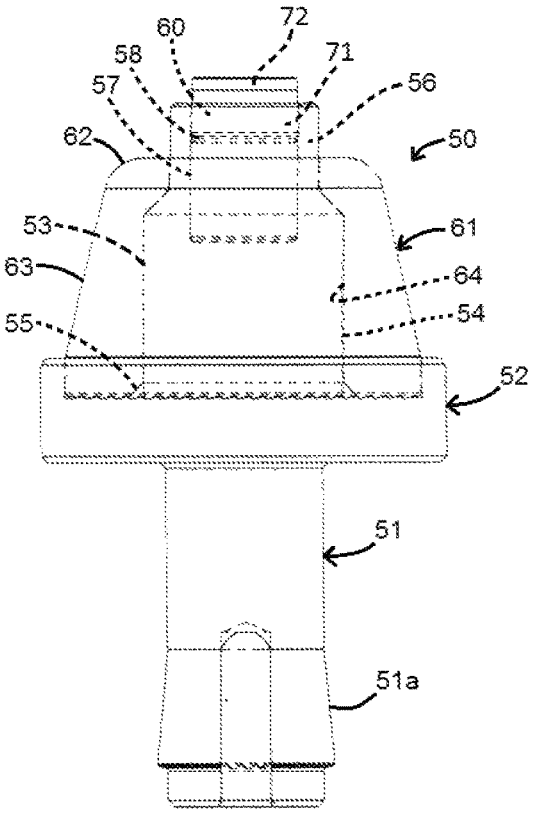
FIG. 6 is a front elevational view of a second embodiment of the bit of the present disclosure.

Referring to FIG. 6, a second embodiment of the bit or tool 50 of the disclosure is shown. The tool 50 includes a shank 51 having a reverse taper portion 51*a*, substantially similar to that shown in the first embodiment and a washer or tire portion 52 of the tool 50 being substantially similar to that shown in the first embodiment of the tool 10. However, an upper body portion 53 of the tool 50 generally has a larger diameter at a base 54 of the upper body portion 53 than the upper portion 13 of the tool 10 of the first embodiment, a smaller solid chamfer transition 55 than the frustoconical portion 40 of the tungsten carbide shield 12 of the tool 10 shown in the first embodiment, and a larger generally cylindrical solid upper body portion 53. The topmost portion of the upper body portion 53 thereafter transitions frustoconically to an annular top 56, similar to the diameter of the top 20 of the upper portion 13 of the tool 10 as shown in the first embodiment. Likewise, the second embodiment of tool 50 includes the sandwich of a tungsten carbide plug 57, a steel disk 58, and a hardened tip or insert 60 with a tungsten carbide substrate or base 71 with has a hardened material layer or coating 72 at the top thereof, similar to that shown in FIG. 5, which is coated with preferably a PCD or diamond material.

The generally annular protective tungsten carbide shroud 61 shown in the tool 50 of the second embodiment has a somewhat differing shape than that shown in the tungsten carbide shield 12 of the tool 10 of the first embodiment. It has an annular generally rounded profile top 62 and a tapering frustoconical side 63 extending downwardly and outwardly to the washer or tire portion 52 of the tool 50. The hollow interior 64 of the shroud 61 is shaped to complementarily conform to the shape of the upper body portion 53, which in this embodiment is made of steel, of the tool body. The tool 50 of the second embodiment of the present disclosure is assembled in the same manner as shown in FIGS. 3-5 with the tool 10 of the first embodiment.

Figure 7:
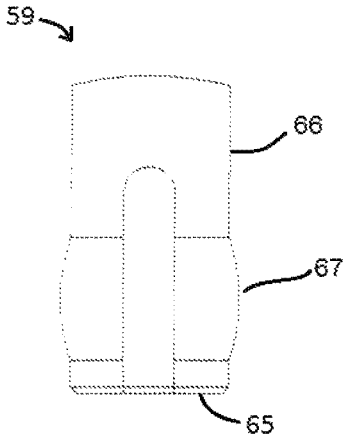
FIG. 7 is a fragmentary elevational view of a first modification of the shank distal end showing a convex bulbous feature.
Figure 8:
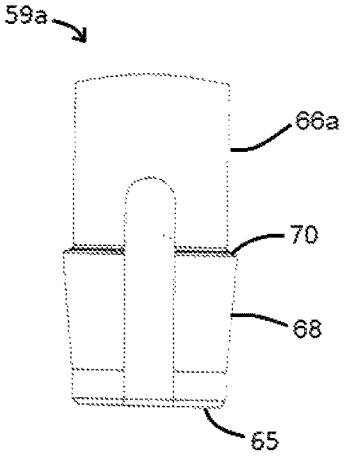
FIG. 8 is a fragmentary elevational view of a second modification of the shank distal end showing a forward taper bulbous feature.

Referring to FIGS. 7 and 8, a first modification 59 and a second modification 59*a* of the tool 10, 50 of the present disclosure include a generally bulbous reverse taper portion adjacent a distal end 65 of the shank 66, 66*a*, respectively. The shank 66 of the first modification 59, shown in FIG. 7, includes a convex shape bulbous portion 67 adjacent the distal end 65 of the shank 66. The shank 66*a* of the second modification 59*a*, shown in FIG. 8, includes an expanded top tapered portion 68 adjacent the distal end 65 of the shank 66*a*. The expanded top tapered portion 68, as shown in FIG. 8, turns out to be a normally tapered portion, but with the top extending outwardly of the rest of the shank 66*a*, in reverse to what would be considered a reverse taper portion 31 shown in the tool 10 of the first embodiment and the tool 50 of the second embodiment.

It should be noted that generally, heretofore, tools or bits have included an annular retainer (not shown) around the outside of the shank of the tool which, generally made of sheet metal, would be somewhat radially compressible in a reduced diameter or cutout section of the shank and by compressing same and putting same in a tool holder bore, would exert some outward pressure to maintain the tool within the tool holder bore (not shown). Those tools have heretofore been generally configured to be rotatable in the bit holder bore.

With the present disclosure, the dimension of the reverse taper portion 31, 51*a* of FIGS. 1-5 and 6, respectively, the convex shape bulbous portion 67 of FIG. 7, and what would be the outsized taper portion 68 of FIG. 8 may be variously dimensioned depending upon what amount of retention or diametrical force is desired between the bit or tool shank and the bit holder bore.

Generally, bit holder bores are nominally 25/32 inch in diameter with the shank being sized to be rotatable therein and restrained somewhat therein by a sheet metal retainer positioned around the outside of the shank. With the present disclosure, the outer diameter, especially of the largest portion of the reverse taper shank may approximate 0.80 to about 0.85 inch in diameter and provide sufficient radial force such that the tool does not rotate in the bit holder bore. This would be preferable as long as the coating or layer on the tip or insert is of PCD or industrial diamond material.

Likewise, the convex shape bulbous portion 67 configuration shown in FIG. 7 may have an outer diameter that retains the bit shank in the bit holder bore with an interference fit. Additionally, the skirt may be sized to be partly rotatable, that is, rotatable (perhaps in 90 degree increments) with a tool such as a channel lock or the like. Further, the skirt may be large enough to fit in that portion between the shank and the bit holder bore such that the tool would not rotate therein.

All these configurations are intended to be utilized with a conventional straight bit holder bore. Within the spirit of the disclosure, additional configurations of the bit holder bore may be found to be practical when utilized with the various modifications of the bit shank shown herein.

Another feature of the present disclosure is the provision of PCD, TSP or industrial diamond tips in hardened bits or tips of tools that may be more easily removable from drums or chains than is heretofore possible with integrally formed bit and bit holders. These are sometimes termed picks that are mountable in base block bores similarly to that of bit holders and which are non-rotatable by design. With prior art tools or bits, or with such picks, entire drums completely outfitted with PCD, TSP or diamond tip picks, have been heretofore utilized on straight portions of highways and the like, with separate drums completely outfitted with tungsten carbide bits used for more severe work such as concrete removal.

The tool or bit described in various embodiments of the instant disclosure enables one to quickly change from tungsten carbide tip bits to diamond tip tools on a single drum enabling quick transitions without substantial down time when removing material from different configurations of highways. Changes from tungsten carbide tip bits to PCD, industrial diamond, or TSP tip bits and vice versa, quickly, even multiple times during a day.

While the present disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A tool comprising:

a metal body comprising a top that includes a bore extending axially inwardly from the top;

a shank depending from a bottom of the metal body;

a metal carbide plug positioned wholly within said bore and bonded in the bore;

a metal disk bonded to a top of the metal carbide plug; and an impact tip being bonded to a top of the metal disk, the impact tip extending outwardly of the top of the metal body.

2. The tool as defined in claim 1, wherein bonded includes brazing.

3. The tool as defined in claim 1, wherein the metal disk starts out as a metal plug extending outwardly of the top of the metal body.

4. The tool as defined in claim 1, wherein the metal disk has a coefficient of expansion that is greater than that of the metal carbide plug, thereby providing greater rigidity to said metal body when in use.

5. The tool as defined in claim 1, wherein the metal disk is heat treated after the metal disk is bonded to the top of the metal carbide plug.

6. The tool as defined in claim 1, wherein the metal (steel) disk forms a sandwich structure with the metal carbide plug immediately below the metal disk and a metal carbide base of the impact tip above the metal disk on the tool.

7. The tool of claim 1, further comprising:

a metal carbide shield mounted to the top of the metal body.

8. A method of making the leading end of a tool body comprising the steps of:

bonding a metal carbide plug wholly within a bore in a top of the tool body;

bonding a metal plug to a top of the metal carbide plug in the bore;

heat treating the top of the tool body;

removing a portion of the metal plug from the tool body, thereby leaving a residual disk in the bore; and bonding an impact tip to a top of the residual disk with the tip extending outwardly of the top of the tool body.

9. The method of claim 8, wherein said heat treating is carried out at a higher first temperature than bonding the impact tip to the top of the metal plug, wherein the bonding of the impact tip is carried out at a second temperature lower than the higher first temperature.

10. The method of claim 8, further comprising the step of:

cooling said tool body to a temperature below that which would cause harm to a diamond impregnated material on the impact tip after the step of heat treating the top of the tool body.

11. The method of claim 8, further comprising:

mounting a metal carbide shield to said top of the tool body before bonding the metal carbide plug in the bore in said top of the tool body.

12. A method of making the leading end of a tool body comprising the steps of:

bonding a metal carbide plug wholly within a bore in a top of the tool body;

bonding a metal plug to a top of the metal carbide plug in the bore;

heat treating the top of the tool body;

removing a portion of the metal plug from the tool body after heat treating the top of the tool body, thereby leaving a residual disk bonding an impact tip to a top of the residual disk with the tip extending outwardly of the top of the tool body.

13. The method of claim 12, wherein said bonding of at least one of the metal carbide plug, the metal plug, and the impact tip comprises brazing.

14. The method of claim 12, wherein removing comprises boring.

15. The method of claim 12, wherein removing comprises drilling.

16. The method of claim 12, wherein removing comprises cutting.

17. The method of claim 12 wherein said heat treating is carried out at a higher first temperature than bonding the impact tip to the top of the metal plug, wherein the bonding of the impact tip is carried out at a second temperature lower than the higher first temperature.

18. The method of claim 12 further comprising the step of:

cooling said tool body to a temperature below that which would cause harm to a diamond impregnated material on the impact tip of the step of heat treating the top of the tool body.

19. The method of claim 12 further comprising:

mounting a metal carbide shield to said top of the tool body before bonding the metal carbide plug in the bore in said top of the tool body.

* * * * *